US005355653A

United States Patent [19]

Henri

[11] Patent Number: 5,355,653

[45] Date of Patent: Oct. 18, 1994

[54] APPARATUS AND METHOD FOR INSTALLING LOOSE FILL OR PARTICULATE INSULATION

[76] Inventor: Clarence Henri, 90 Spruce St., Moncton, New Brunswick, Canada, E1C 7K3

[21] Appl. No.: 38,785

[22] Filed: Mar. 29, 1993

[51] Int. Cl.[5] ..... E04F 21/06; E04B 2/10

[52] U.S. Cl. ..... 52/743; 52/749; 52/404.1

[58] Field of Search ..... 52/743, 749, 404.1, 52/404.2, 404.3, 404.4, 404.5

[56] References Cited

U.S. PATENT DOCUMENTS 4,021,972 5/1977 Choate .
4,134,242 1/1979 Musz .
4,177,618 12/1979 Felter .
4,292,777 10/1981 Story .
4,328,652 5/1982 Naumovich .
4,342,181 8/1982 Truesdell .
4,385,477 5/1983 Walls et al. .
4,712,347 12/1987 Sperber .
4,829,738 5/1989 Moss .

*Primary Examiner*—Carl D. Friedman
*Assistant Examiner*—Christopher Todd Kent

[57] ABSTRACT

An apparatus for facilitating the installation of a flowable insulation in a wall or ceiling cavity comprises a rigid rectangular frame. A pair of transverse runners releasably receives an apertured slide panel and a pair of slide screen panels. When all three panels are received by the runners, they extend between the sides of the frame. A metal screen or wire mesh covers the frame other than at the runners. The apertured panel may be repositioned by removing one of the panels and sliding the other two to a different position then reinserting the removed panel. The frame may be pressed against a wall cavity and the apertured panel positioned so that it is not obstructed. An insulation hose may then inserted through the aperture in the apertured panel and insulation blown into the cavity; subsequently the apparatus may be removed. In another embodiment a pair of adjustable legs extend from the bottom of the frame and a row of teeth extends along the top of the frame so that the frame may be pressed against the top of the wall cavity. In a further embodiment the adjustable legs may be pivotally joined medially along the sides of the frame and used to support the frame against ceiling joints so that insulation may be blown into the ceiling cavity between these joints.

11 Claims, 6 Drawing Sheets

APPARATUS AND METHOD FOR INSTALLING LOOSE FILL OR PARTICULATE INSULATION

BACKGROUND OF THE INVENTION

1. Field of the Invention

The present invention relates to an apparatus and method facilitating the installation of a loose fill or particulate insulation in an open wall or ceiling cavity.

2. Description of the Related Art

Various methods and apparatus for installing loose fill or particulate insulation in an open wall or ceiling cavity are known. Traditional methods use a membrane or plastic sheet which is stapled or nailed to studs and joists so that the cavity is enclosed before insulation is installed. The membrane remains in place once insulation installation is complete.

U.S. Pat. No. 4,829,738 issued May 16, 1989 to Moss discloses a method to install insulation using a removable pressure plate that substantially encloses the open wall cavity. A drawback to this method is that the pressure plate, depending on the size of the wall cavity, can be quite large and cumbersome to work with.

Accordingly, it would be advantageous to provide an apparatus for facilitating the installation of flowable insulation in an open wall or ceiling cavity, which is adaptable to any cavity, which is removable, and which is easy to position and operate.

SUMMARY OF THE INVENTION

According to the present invention, there is provided apparatus for facilitating the installation of loose fill or particulate insulation in a building wall or ceiling under construction, said wall or ceiling having an open cavity bounded by a back surface, side supports and end supports, said apparatus comprising: a rigid rectangular frame having a pair of side members, a first end member and a second end member, the distance between said side members being at least as great as the distance between side supports bounding a cavity with which said frame is intended for use; a pair of transverse runners extending between said side members, said pair of transverse runners defining a space therebetween; a panel slidably received by said pair of runners, said panel having an insulation hose receiving aperture; screen means extending between said side members and of said first and second end members exteriorly of the space between said at least one pair of transverse runners, whereby said frame may be pressed against the side supports bounding an open cavity to form a front surface for said cavity, an insulation hose may be received by said insulation hose receiving aperture and insulation may be blown into said cavity.

According to another aspect of the invention, there is provided a method of installing a loose fill or particulate insulation in a building wall or ceiling under construction, said wall or ceiling having an open cavity bounded by a back surface, side supports and end supports, comprising the steps of: pressing a rigid rectangular frame against the side supports of said cavity, said frame having a pair of side members, a first end member, a second end member, a pair of transverse runners extending between said side members, said pair of transverse runners defining a space therebetween, a panel slidably received by said at least one pair of runners, said panel having an insulation hose receiving aperture, screen means extending between said side members and of said first and second end members exteriorly of the space between said at least one pair of transverse runners; fitting an insulation hose to said aperture in said apertured panel; sliding said apertured panel to a position whereat said hose is not impeded by any obstacles in said cavity; blowing insulation through said hose so that said insulation fills said cavity; and removing said frame.

DETAILED DESCRIPTION OF THE INVENTION

Figure 1:
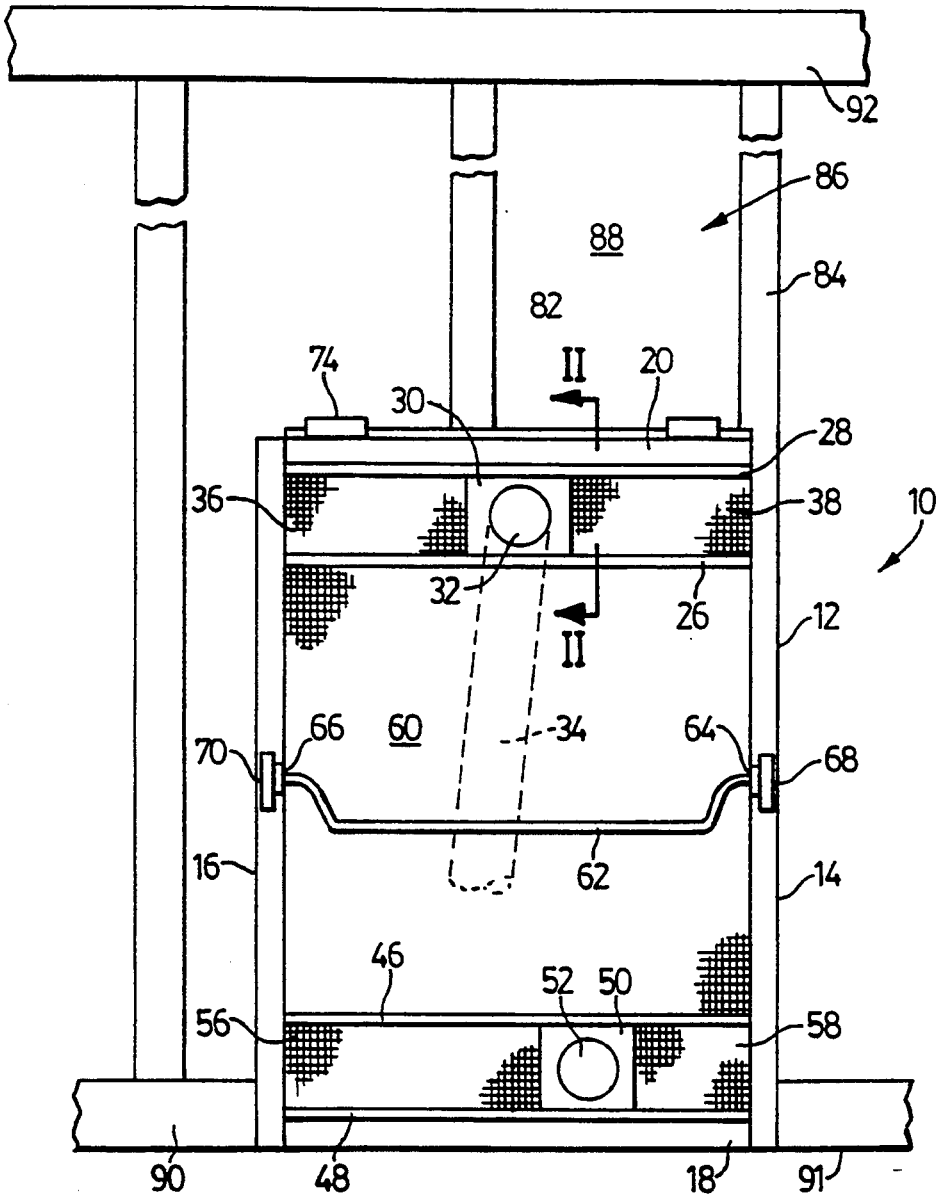
FIG. 1 is a plan view of apparatus made in accordance with one embodiment of this invention shown in position over a wall cavity.

Referencing FIGS. 1, apparatus 10 for facilitating the installation of loose fill or particulate insulation comprises a rigid rectangular frame 12 having a pair of side members 14, 16, a bottom end member 18, and a top end member 20. A transverse runner 28 extends between side members 14, 16 adjacent top end member 20. A second transverse runner 26 extends between the side members spaced from runner 28. A panel 30 is slidably received by the runners 26, 28. The panel 30 has a hose receiving aperture 32 therein; a hose 34 is shown in phantom extendingthrough this aperture 32. Two screen panels 36, 38 are slidably received by the runners 26, 28. Similarly, a pair of spaced transverse runners 48, 50 extend between sides 14 and 16 of the frame with runner 48 adjacent bottom end member 18. A panel 50 with an aperture 52 and screen panels 56, 58 are slidably received by the runners 46, 48. A screen 60 extends between the side members 14 and 16 of the frame and between runners 26 and 46. A handle 62 extends between pivot mounts 64 and 66 on side members 14 and 16, respectively. A pair of clevis mounts 68 and 70 are positioned on side members 14 and 16 adjacent pivot mounts 64, 66. Top end member 20 supports pivot brackets 74 which releasably and rotatably receive a rod 76. The rod is attached to a baffle, as will be seen in reference to FIG. 2.

Figure 2:
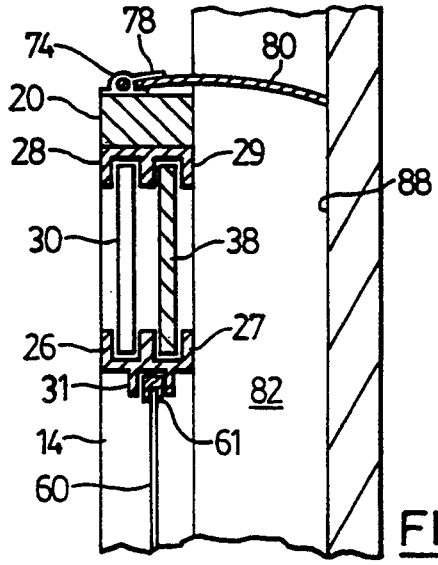
FIG. 2 is a cross-sectional view along the lines II—II of FIG. 1.

Turning to FIG. 2, rod 76 has a hinge 78 which is attached to baffle 80. Runners 26, 28 have opposed W-shaped channels 27, 29 one notch of which receives the panels 36 (FIG. 1) and 38 and the other of which receives the panel 30. The panels may be slid along the runners. Screen 60 is mounted in a frame 61 which is received by a lower U-shaped channel 31 of runner 26.

Returning to FIG. 1, runners 46 and 48 are similarly configured to runners 26 and 28, respectively, and receive panels 50, 56, 58. Additionally, runner 46 has a U-shaped channel to receive the frame 61 for the screen 60.

Apparatus 10 is shown placed against adjacent studs 82, 84 of a wall cavity 86 bounded by the studs, a back surface 88 and joists 90 and 92.

Figure 3:
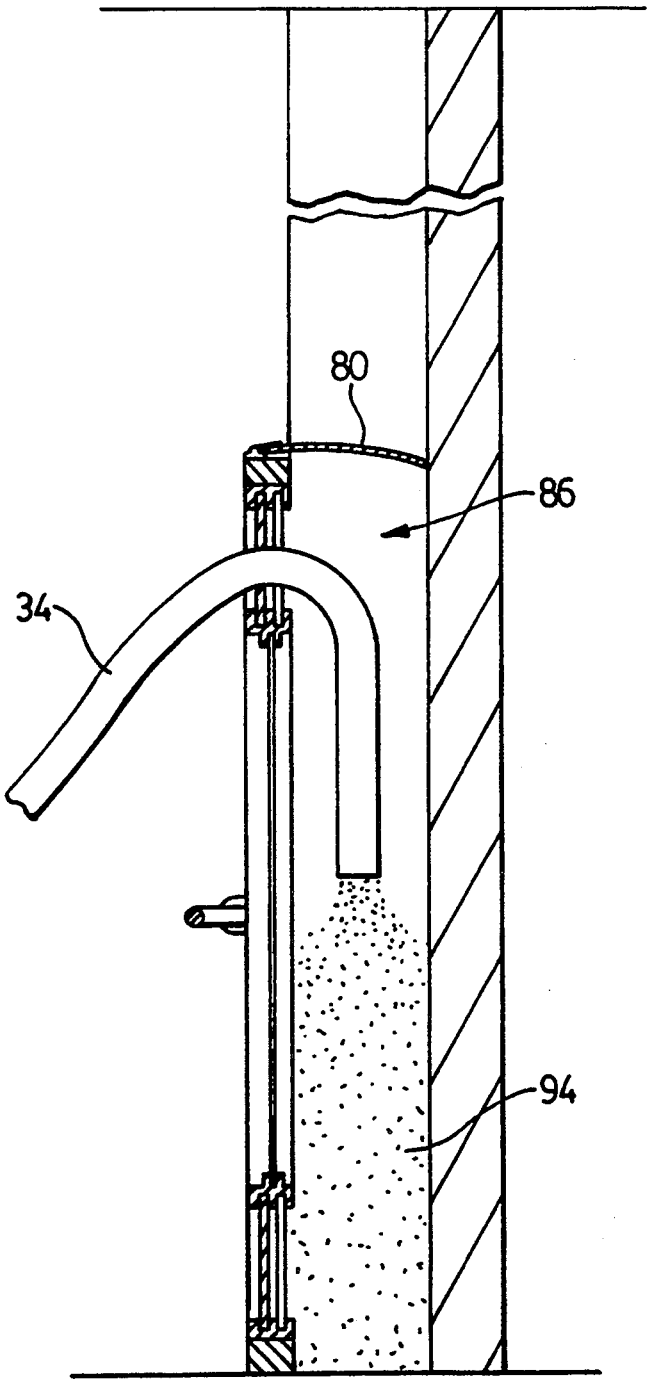
FIG. 3 is a cross-sectional side view of the apparatus of FIG. 1 in use.

The operation of the apparatus of FIGS. 1 and 2 is described in connection with these figures along with FIG. 3. An operator grasps handle 62 in order to press apparatus 10 against adjacent studs 82, 84 of a wall cavity 86 with the bottom member 18 of the frame 12 resting against the floor 91. In this regard, note that apparatus 10 must have a width sufficient to bridge the gap between studs 82 and 84. Rod 76 is then rotated so that baffle 80 is placed in the position shown in FIGS. 2 and 3. Next, if the aperture 32 in apertured panel 30 is obstructed by a switch box or other obstruction, the apertured panel 30 may be slid to abut side 14 or 16 of frame 12 and one of the screen panels 36, 38 slid to meet the other of the two screen panels so that the panels 30, 36, 38 extend from side member 14 to side member 16. Next, an insulation hose 34 is slid through the aperture 32 and a loose fill or particulate insulation is blown through the hose to fill the wall cavity 86 with insulation 94 up to baffle 80. While filling the cavity up to baffle 80, the hose 34 is slowly withdrawn from the cavity through aperture 32. Once the cavity has been filled up to baffle 80, an operator may pull the apparatus 10 away from the wall cavity utilizing handle 62 and the insulation will remain in place.

If it is not possible to find a position for apertured panel 30 which is unobstructed, apparatus 10 may be inverted. Since screen panel 56 is longer than screen panel 58, it will be appreciated that apertured panel 50 may be positioned at additional locations to the locations at which apertured panel 30 may be positioned.

Figure 4:
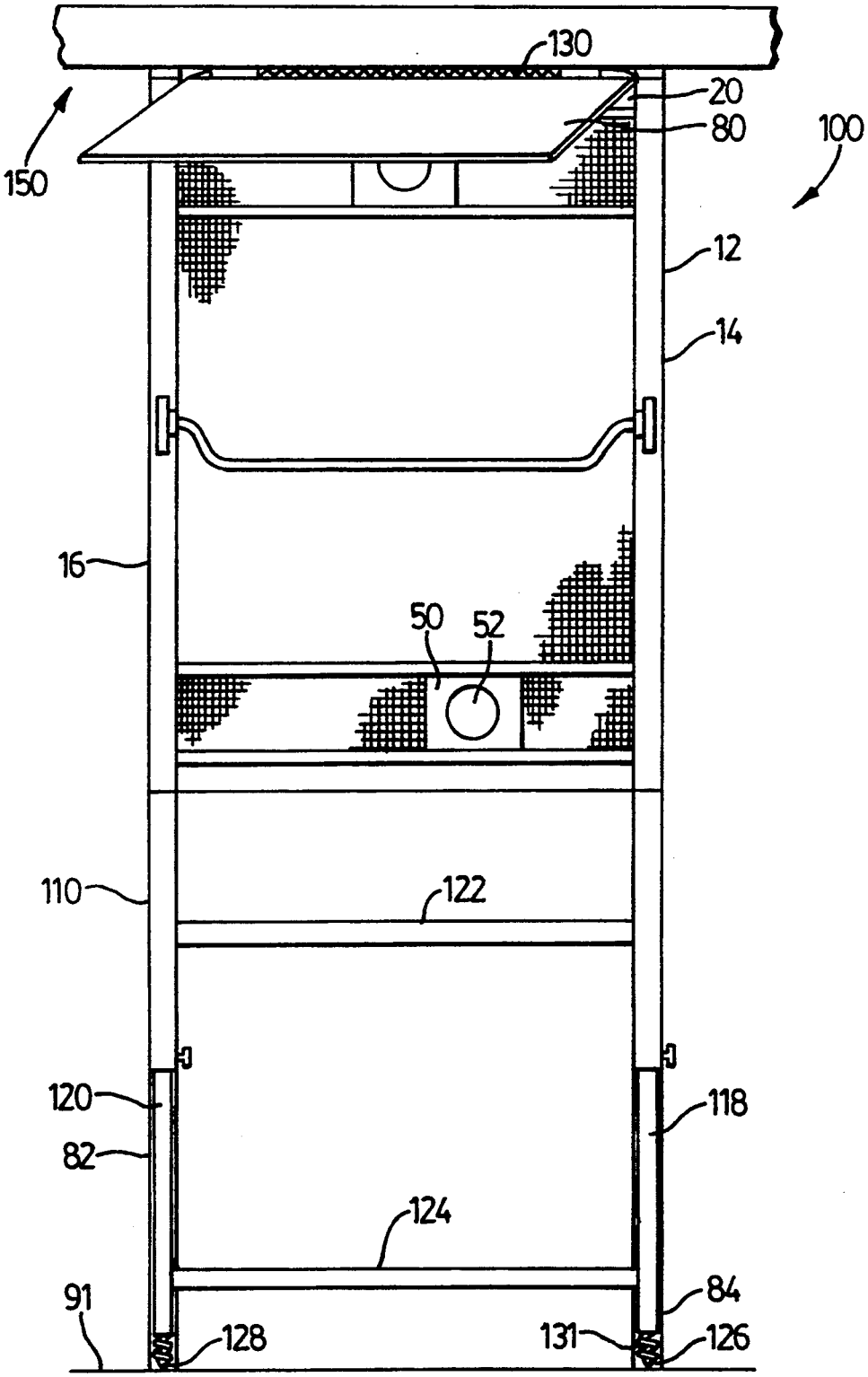
FIG. 4 is a plan view of another embodiment of this invention.
Figure 5:
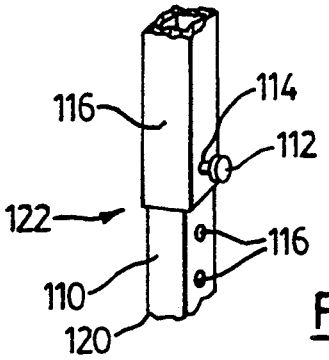
FIG. 5 is a side view of a portion of FIG. 4.

Turning to FIGS. 4 and 5 which illustrates another embodiment of this invention, apparatus 100 comprises a frame 12 (which is identical to frame 12 of apparatus 10 described in connection with FIG. 1), a row of teeth 130 attached to the top member 20 of frame 12, and an adjustable leg set 110. Leg set 110 has legs 118 and 120. As seen in FIG. 5, leg 120 is inserted through the hollow end 122 of side members 16 of the frame 12 and held in place by pin 112 which extends through hole 114 in the side member 16 and through one of the holes 116 in the leg 120 which has been aligned with hole 114. Leg 118 is similarly held in side member 14. A cross brace 122 and a step plate 124 extend between legs 118 and 120. Anchor pins 126 and 128 project from legs 118 and 120, respectively, and are biased to a projecting position by springs 131.

Apparatus 100 is shown placed against studs 82 and 84 and between the floor 91 and ceiling joints 150.

Figure 6:
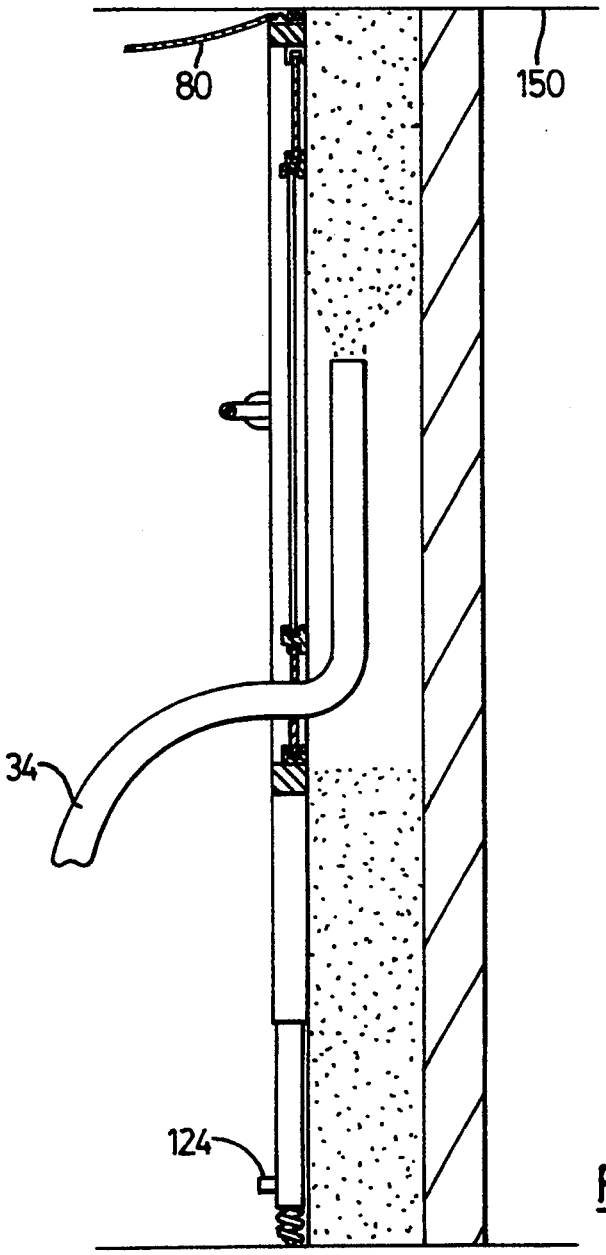
FIG. 6 is a cross-sectional side view of the apparatus of FIGS. 4 and 5 in use.

The operation of the apparatus of FIGS. 4 and 5 is described in conjunction with these figures along with FIG. 6. Once a wall cavity 86 has been filled part way by apparatus 10, adjustable leg set 110 is fitted to the frame 12 of apparatus 10 as is a row of teeth 130 (after baffle 80 has been flipped out of the way) to convert the apparatus 10 to apparatus 100. Next, the operator places anchor pins 126 and 128 on the floor adjacent studs 82 and 84 of the wall cavity 86 partially filled by apparatus 10 of FIG. 1. The operator then steps on step plate 124 to lower apparatus 100 by pressing the pins 126, 128 into their respective legs. An attempt may then be made to press apparatus 100 against studs 82 and 84. If apparatus 100 turns out to be too long, pins 112 may be removed and a new set of holes 116 in the legs 118, 120 aligned with holes 114 in the side members 14, 16 in order to shorten the leg set 110. Another attempt may then be made to install apparatus 100. Once apparatus 100 is pressed against the studs 82, 84, the operator releases step plate 124 so that the anchor pins 126, 128 again extend to press the row of teeth 130 into the ceiling joints 150. This stabilizes the apparatus 100 in place. Next, an insulation hose 34 is positioned through aperture 52 in panel 50 as shown in FIG. 6 such that the end of the hose is directed toward ceiling joints 150. Insulation may then be blown into the wall cavity while the hose is slowly retracted through aperture 52.

It will be apparent that apparatus 10 (FIG. 1) and apparatus 100 (FIG. 4) are complimentary, apparatus 10 being used to fill the lower portion of a wall cavity with insulation and apparatus 100 being used to fill the upper portion of the same wall cavity.

Figure 7:
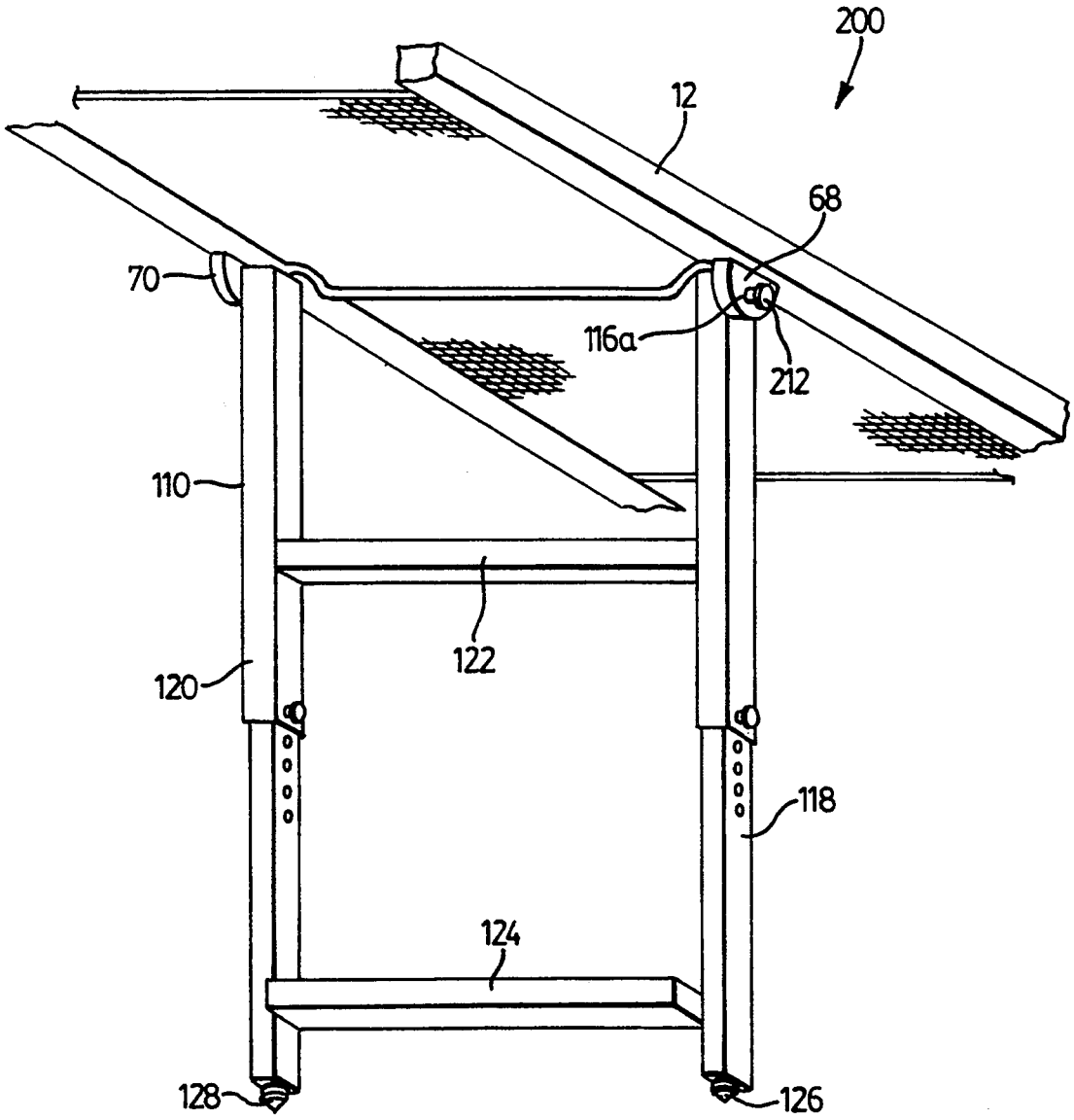
FIG. 7 is a perspective view of another embodiment of the apparatus of this invention.

FIG. 7 illustrates apparatus 200 adapted for installing insulation in a ceiling. Apparatus 200 comprises frame 12 (described in conjunction with FIGS. 1 and 2) and leg set 110 (described in conjunction with FIGS. 4 and 5). However, in apparatus 200, the hole **116*a* in the ends of legs 118 and 120 is aligned with the openings of clevis mounts 68 and 70 and pivotally held in place by pins 212**.

Figure 8:
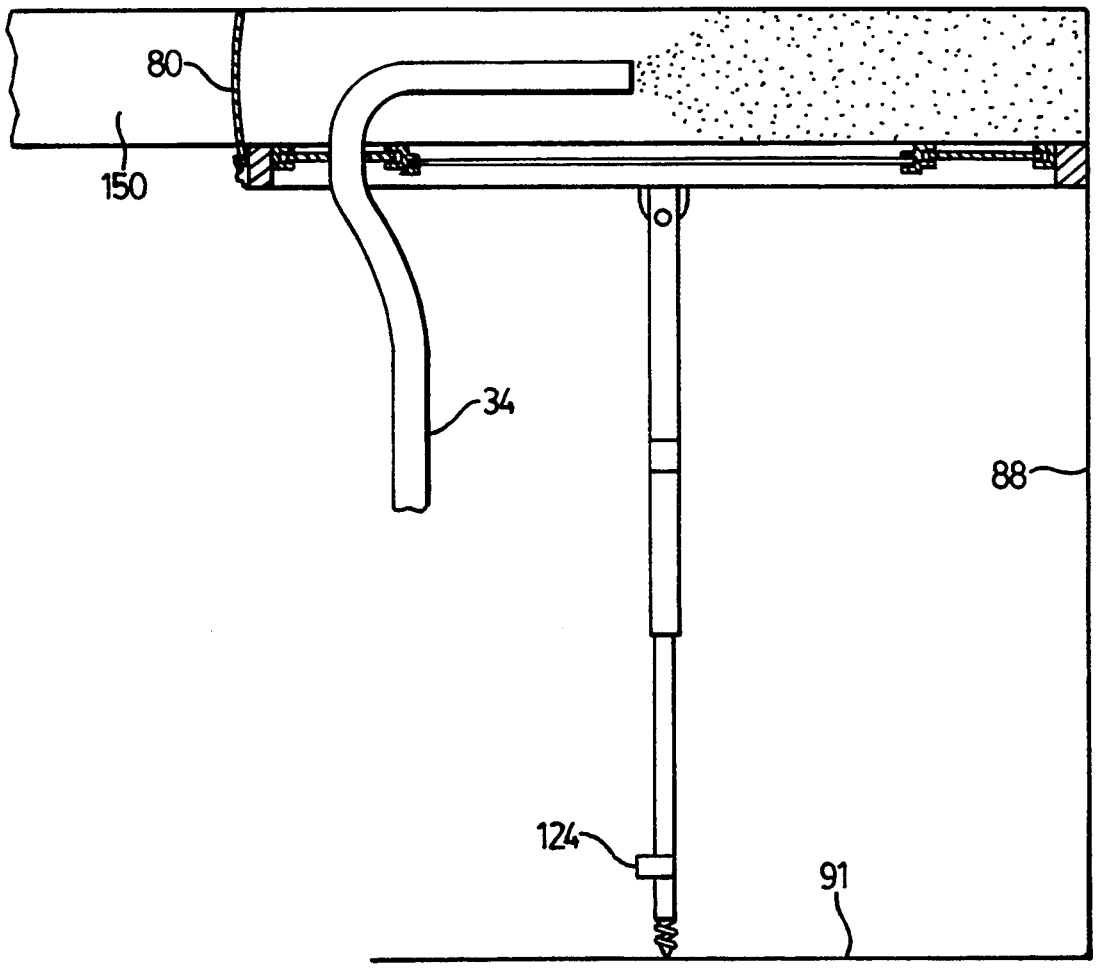
FIG. 8 is a cross-sectional view of the apparatus of FIG. 7 in use.

The operation of the apparatus 200 is described in conjunction with FIG. 7 along with FIG. 8. The operator stands below a pair of ceiling joists bounding a cavity to be filled and steps on step plate 124 to depress spring loaded pins 126, 128 into legs118, 120, respectively. Apparatus 200 is then positioned below the pair of adjacent ceiling joints 150 and the step plate released so that the apparatus 200 rises to press against the ceiling joints 150. Hose 34 may now be inserted through aperture 32 or 52 and insulation blown between the ceiling joints. As illustrated in FIG. 8, the ceiling cavity may be bounded by a wall surface 88 or by the edge of insulation installed in the ceiling with a prior use of apparatus 200.

It will be apparent that all of apparatuses 10, 100 and 200 may be employed by a single operator.

At least one of the side members 14 and 16 may be removable from the frame 12 so that screen 60 in screen frame 61 may be slid from frame 12 and replaced with another screen in screen frame assembly. In this way, the mesh size of the screen may be adjusted depending upon the type of insulation to be used. The screen used in the screen frame 61 is metal screen or wire mesh.

Apparatus 10 could be modified so that it extends the length of a wall between joints 90 and 92. In such case, apparatus 100 would not be required. Other modifications will be apparent to those skilled in the art and, accordingly, the invention is defined in the claims.

What is claimed is:

1. An apparatus for facilitating the installation of loose fill or particulate insulation in a building wall or ceiling under construction, said wall or ceiling having an open cavity bounded by a back surface, side supports and end supports, said apparatus comprising:

a rigid rectangular frame having a pair of side members, a first end member and a second end member, the distance between said side members being at least as great as the distance between side supports bounding a cavity with which said frame is intended for use;

at least one pair of transverse runners extending between said side members, said at least one pair of transverse runners defining a space therebetween;

a panel slidably received by said at least one pair of transverse runners, said panel having an insulation hose receiving aperture;

screen means extending between said side members and of said first and second end members exteriorly of the space between said at least one pair of transverse runners, whereby said frame may be pressed against the side supports bounding an open cavity to form a front surface for said cavity, an insulation hose may be received by said insulation hose receiving aperture and insulation may be blown into said cavity.

2. The apparatus of claim 1 including a plurality of screen panels slidably received by said at least one pair of transverse runners, said apertured panel and said plurality of screen panels positionable to extend between said side members.

3. The apparatus of claim 1 including an adjustable length leg extending along each of said side members and beyond said first end member whereby said frame is adapted for use with a wall cavity and may be adjusted so that said second end member abuts an upper end support bounding a wall cavity.

4. The apparatus of claim 3 including an anchor pin carried by each of said legs., each said anchor pin biased to an extended position whereat said anchor pin extends beyond the free end of the leg which carries said anchor pin.

5. The apparatus of claim 4 including a row of teeth projecting from said second end member in the plane of said frame.

6. The apparatus of claim 2 including a flexible baffle extending along said second end member between said side members, said flexible baffle having a first position whereat said flexible baffle extends generally normally from the plane of said frame whereby, when said frame is pressed against the side supports bounding a cavity, said baffle extends toward the back surface bounding said cavity so that if said first end of said frame rests against one of said end supports bounding said cavity, said cavity is completely enclosed.

7. The apparatus of claim 6 including a rod releasably supported by said frame adjacent said second end member, said rod carrying said baffle.

8. The apparatus of claim 1 including a pivot mount carried on each of said side members of said frame medially of said first and second end members and an adjustable length leg pivotally mounted to said pivot mounts whereby said frame may be held against the side supports bounding a ceiling cavity.

9. The apparatus of claim 8 including an anchor pin carried by said leg, said anchor pin biased to an extended position whereat said anchor pin extends beyond the free end of said leg.

10. A method of installing a loose fill or particulate insulation in a building wall or ceiling under construction, said wall or ceiling having an open cavity bounded by a back surface, side supports and end supports, comprising the steps of:

pressing a rigid rectangular frame against the side supports of said cavity, said frame having a pair of side members, a first end member, a second end member, at least one pair of transverse runners extending between said side members, said at least one pair of transverse runners defining a space therebetween, a panel slidably received by said at least one pair of runners, said panel having an insulation hose receiving aperture, screen means extending between said side members and of said first and second end members exteriorly of the space between said at least one pair of transverse runners;

fitting an insulation hose to said aperture in said apertured panel;

sliding said apertured panel to a position whereat said hose is not impeded by any obstacles in said cavity;

blowing insulation through said hose so that said insulation fills said cavity; and removing said frame.

11. The method of claim 10 including the step of sliding screen panels received by said runners such that said screen panels together with said apertured panel extend between said pair of side members prior to said step of blowing insulation.

* * * * *